US008083125B2

(12) United States Patent
Vanhoutte

(10) Patent No.: US 8,083,125 B2
(45) Date of Patent: Dec. 27, 2011

(54) TWO-PIECE PASTRY BOX

(76) Inventor: Guy Vanhoutte, Oudenaken (BE)

( * ) Notice: Subject to any disclaimer, the term of this patent is extended or adjusted under 35 U.S.C. 154(b) by 295 days.

(21) Appl. No.: 12/051,063

(22) Filed: Mar. 19, 2008

(65) Prior Publication Data

US 2009/0008389 A1 Jan. 8, 2009

(30) Foreign Application Priority Data

Mar. 19, 2007 (EP) ..... 07104440

(51) Int. Cl.
*B65D 6/22* (2006.01)

(52) U.S. Cl. ..... 229/117.07; 220/810

(58) Field of Classification Search ..... 229/125.29, 229/122.34, 126, 125.08, 117.07, 117.08, 229/122.32, 178, 172; 220/810
See application file for complete search history.

(56) References Cited

U.S. PATENT DOCUMENTS

| | | | | |
|---|---|---|---|---|
| 2,770,410 | A * | 11/1956 | Williamson | 229/168 |
| 3,985,289 | A | 10/1976 | Prince | |
| 3,987,957 | A * | 10/1976 | Johnson | 229/152 |
| 4,058,249 | A * | 11/1977 | Buck | 206/509 |
| 4,960,238 | A * | 10/1990 | Lorenz | 229/125.29 |
| 5,044,549 | A * | 9/1991 | Beales | 229/125.27 |
| 7,234,629 | B2 * | 6/2007 | Ho | 229/117.08 |

FOREIGN PATENT DOCUMENTS

| | | | |
|---|---|---|---|
| DE | 509 360 | C | 10/1930 |
| EP | 623 519 | A1 | 11/1994 |
| EP | 1 731 441 | A | 12/2006 |

* cited by examiner

*Primary Examiner* — Nathan J Newhouse
*Assistant Examiner* — Christopher Demeree
(74) *Attorney, Agent, or Firm* — Sughrue Mion, PLLC

(57) ABSTRACT

A box, in particular a pastry box, comprising a coverlid and a base recipient, said coverlid being applied on said base recipient, said coverlid comprising a first side provided to form a top plane and a second side provided to form a front plane of said box, said first and second side having a common edge, a border of said first side, which border is situated opposite to said common edge, is provided with a strip, which strip extends substantially perpendicular to said first side when said coverlid is mounted on said base recipient, said base recipient comprises a back wall, which is upstanding when said base recipient is unfolded, said strip being attached to said back wall, said base recipient being foldable, said back wall comprising a first and a second flap forming an integral part with each other and being foldable with respect to each other in such a manner that they overlap each other when said back wall is upstanding, said base recipient further comprising a first, respectively a second, side wall hingedly connected by means of a first, respectively a second wing to said back wall in such a manner that upon unfolding said base recipient the upstanding movement of said back wall causes said side wall to become upstanding too.

17 Claims, 4 Drawing Sheets

TWO-PIECE PASTRY BOX

The present invention relates to a box, in particular a pastry box, comprising a coverlid and a base recipient, said coverlid being applied on said base recipient, said coverlid comprising a first side provided to form a top plane and a second side provided to form a front plane of said box, said first and second side having a common edge, a border of said first side, which border is situated opposite to said common edge, is provided with a strip, which strip extends substantially perpendicular to said first side when said coverlid is mounted on said base recipient, said base recipient being foldable and provided to be stored and stacked when folded up, said base recipient comprises a back wall, which is upstanding when said base recipient is unfolded, said back wall having a first and a second flap forming an integral part with each other and being foldable with respect to each other in such a manner that they overlap each other when said back wall is upstanding, said base recipient further comprising a first, respectively a second side wall hingedly connected by means of a first, respectively a second wing to said back wall.

Such a box is known from U.S. Pat. No. 3,985,289 and used in particular for packing pastries. In the known box the coverlid is removably applied to the base recipient. The coverlid is attached to the base recipient by means of a flat strip having a projection fitting into a slot applied in the back wall of the base recipient. The side walls and the back wall are each time hingedly connected to each other by means of wings. When unfolding the known box, starting from a folded status, the wings are creased inwardly thereby elevating the side walls and the outer panels.

A drawback of the known box is that the unfolding of the side and the back walls requires a precise creasing of the wings. It is indeed necessary to crease them precisely along the fold line extending between the two segments of which each of the wings are formed, thereby taking care that the wing segments are well folded towards each other, which is time consuming. Moreover, the base recipient and the coverlid have to be stacked as separate items.

It is an object of the invention to provide a box of which the mounting of the coverlid and the base recipient are less time consuming and whereby the coverlid and the base recipient can be stacked as one item.

For this purpose a box according to the present invention is characterised in that said strip is attached to said first flap, and wherein said first and second wing are connected to said first flap in such a manner that upon unfolding said base recipient by a movement of said coverlid causing an upstanding movement of said back wall the thereby induced hinged movement of the flap will cause said side wall to become upstanding too. As the strip, which belongs to the coverlid, is attached to the first flap, which is part of the base recipient, the base recipient and the coverlid are attached to each other. So, the coverlid and the base recipient form a whole and can be stacked together. The use of the first and the second flap and the use of the first and second wing enable the wings to impose an upstanding movement on the side walls when the coverlid, which is attached to the base recipient, is tilted up. As so the unfolding of the base recipient can be done by simply tilting up the coverlid, the unfolding movement becomes much easier to handle and is less time consuming.

A first preferred embodiment of a box according to the invention is characterised in that said first and second wing extend between said first and second flap when said back wall is upstanding. In such a manner, the wings are enclosed by the flaps, thereby avoiding that the wing could fall down and so let the base recipient collapse.

A second preferred embodiment of a box according to the invention is characterised in that said first flap forms an outer part of said back wall and said second flap forms an inner part of said back wall. In such a manner they are juxtaposed when the box is unfolded and reinforce the construction of the box.

A third preferred embodiment of a box according to the invention is characterised in that said second flap comprises a bendable lip applied on a border thereof, said base recipient further comprising a bottom side provided with a slit, said slit being dimensioned and applied such as to engage said bendable lip when said base recipient is unfolded. In such a manner the second flap is attached to the bottom side and there is avoided that the second flap could move when the box is unfolded.

A fourth preferred embodiment of a box according to the invention is characterised in that said first and second wings each comprise a first and a second segment pivotably linked to each other, said first segment being attached to said side wall and said second segment being attached to said first flap. The pivot connection between the first and second segment enables a reliable unfolding of the side walls.

Preferably said first and second segment are triangularly shaped. This enables an easy construction of the wings.

A fifth preferred embodiment of a box according to the invention is characterised in that said second segment is glued to said first flap. Gluing enables a reliable and quick attachment of the flaps and the wings.

Preferably said coverlid is made of transparent plastic material. The use of a transparent coverlid enables that the consumer sees through the transparent coverlid what kind of pastry the box contains, thereby permitting a hygienic storage of the pastry.

Preferably said second side of said coverlid is provided with a closure lid and said base recipient with a further slit, said closure lid being provided to engage into said further slit upon closing said box. This permits a reliable closure of the box.

The invention will now be described in more details with reference to a preferred embodiment illustrated in the annexed drawings.

Figure 1:
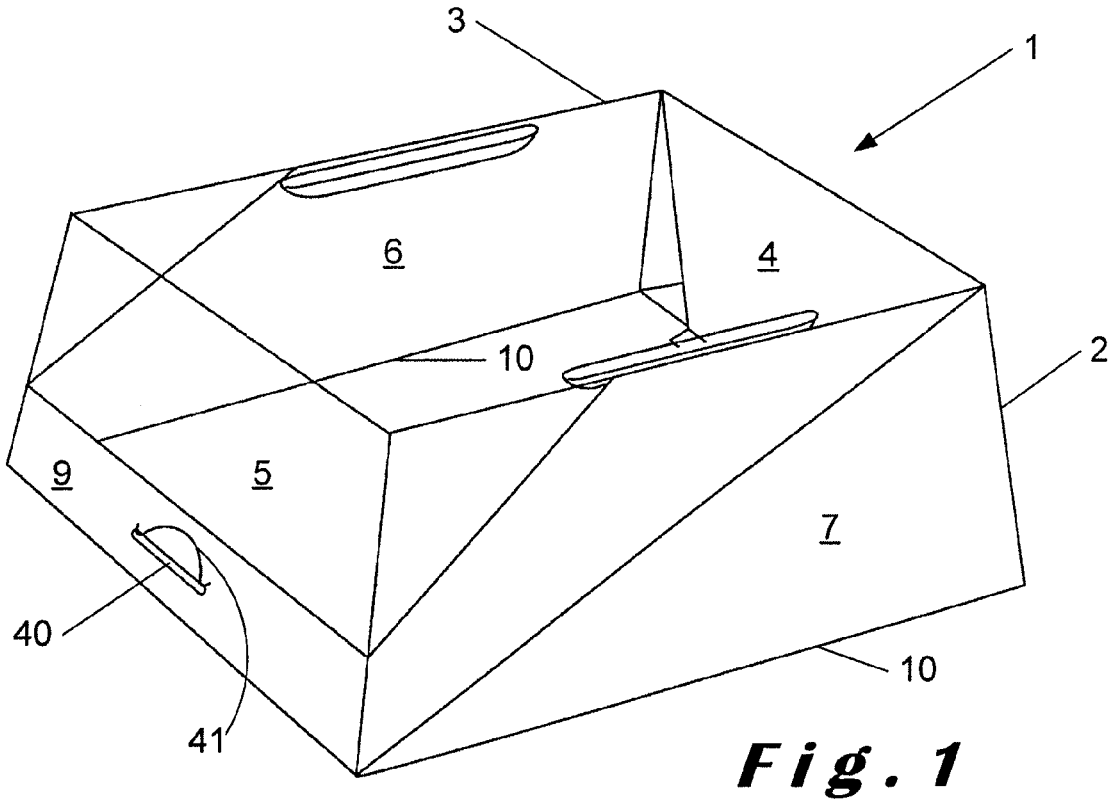
FIG. 1 shows an overall view of a box according to the invention.

In the drawings, a same reference sign has been allocated to a same or analogous element.

The box 1 illustrated in FIG. 1 is in particular provided for packing pastries. The invention is however not limited to a pastry box and the box could also be used for other objects such as toys, pens or the like. The box comprises a base recipient 2, preferably made of cardboard and a coverlid 3 preferably made of transparent material, in particular plastic material, such as PET. The advantage of using PET is that it can be thermoformed. The fact that the coverlid is made of transparent material enables to see the stuff stored in the box through the coverlid. Using cardboard for the base recipient enables to give the pastry box its familiar look of a quality pastry.

The base recipient 2 comprises a back wall 4, which is preferably shaped as a trapezium and wherein the upper border of the back wall forms the upper border of the trapezium. The trapezium shape of the back wall matches with the trapezium shape of the cover lid 3 and enables an easy and space saving stacking of the box.

The base recipient 2 further comprises a bottom side 5 and two lateral side walls 6 and 7. The lateral side walls are hingedly connected to the back wall and the bottom side in order to fold up the side walls of the base recipient. Folding lines 10 applied on the lateral side walls 6 and 7 contribute also to the folding up of the base recipient. The front end of the lateral side walls 6 and 7 have preferably an inclined shape in order to facilitate the closure by the closure lid 3 and enable a lateral look into at least a part of the box. A first strip 9 extends from the bottom side 5 of the base recipient. The first strip extends substantially perpendicular to the bottom side when the box is in mounted configuration. The first strip is preferably trapezium shaped, an upper border of the trapezium forming the upper border of the first strip.

Figure 2:
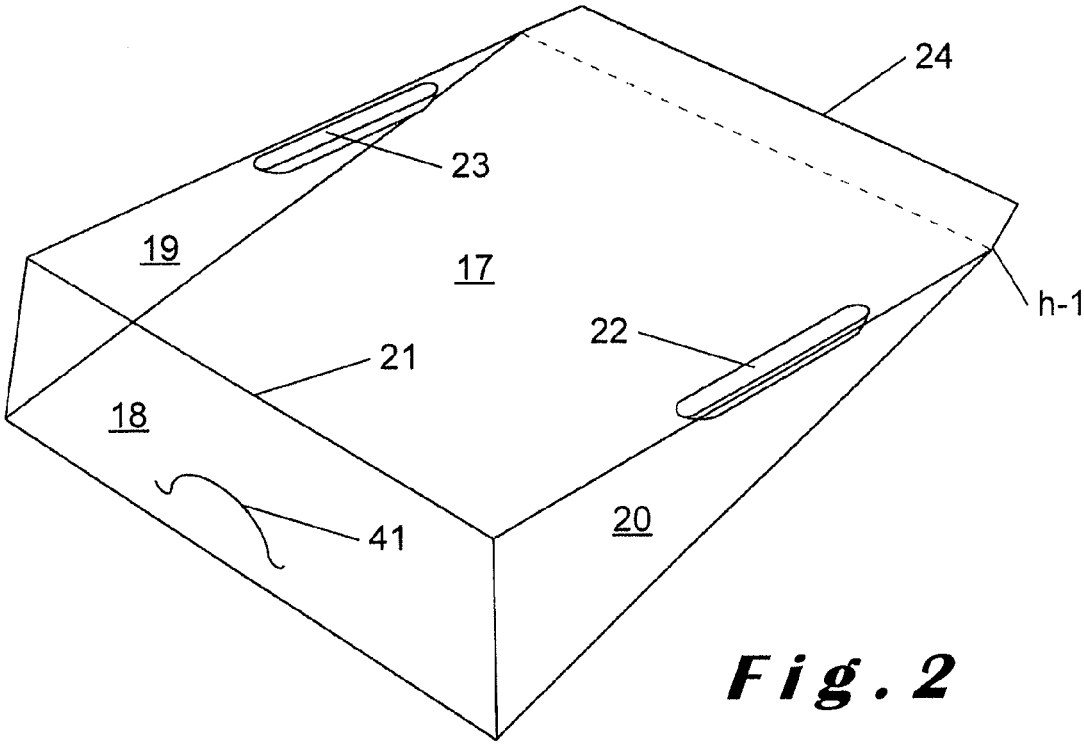
FIG. 2 shows a detailed view of a coverlid as a component of a box according to the invention.

The coverlid 3 illustrated in FIG. 2 comprises a first side 17 provided to form a top plane of the coverlid when mounted on the base recipient. A second side 18 of the coverlid is provided to form a front plane of that coverlid. The first and second side have a common edge 21 connecting them. The coverlid is further provided with lateral sides 19 and 20 linked to the first and second side. The lateral sides are preferably triangularly shaped as this facilitates the manufacturing of the coverlid by thermoformation and enables to apply a second strip 24, which extends in the same plane as the first side 17 after formation.

The second side 18 of the coverlid is preferably trapezium shaped, where the common edge 21 forms the top side of the trapezium. The trapezium shape of this second side also favourably contributes to the manufacturing of the coverlid by thermoformation.

The first side 17 of the coverlid preferably comprises a first 22 and a second 23 elongated cavity extending each time along a fraction of a lateral border of the first side The elongated cavities form, as if to say, grooves in the top plane of the coverlid and extend inwardly of the base recipient when the coverlid is mounted on the base member. The elongated cavities serve to retain the lateral side walls 6 and 7 of the base recipient when the coverlid is mounted thereon and avoid in such a manner that the lateral side walls 6 and 7 collapse and could damage the pastry stored inside the box.

A border of the first side 17, which is situated opposite to the common edge 21 is provided with the second strip 24. The second strip is preferably made of the same material as the one of which the coverlid is made. The second strip 24 is preferably hingedly applied on the border of the coverlid and the border forms a hinge line h-1. The second strip extends over substantially the whole length of the border and has preferably rounded extremities. The hinged connection between the first side 17 and the second strip 24 is preferably obtained by applying along the first hinge line h-1 segmentwise cuts into the material of which the coverlid is made. Alternatively the second strip 24 could not extend over the whole length of the border and be made by one or more segments.

It is however preferred that when the coverlid 1 is mounted on the base recipient 2, the second strip 24 extends substantially perpendicular with respect to that side of the coverlid on which it is applied. In the preferred embodiment, shown in the FIGS. 2 and 5, the strip is applied on the first side 17 of the coverlid.

The box further comprises a closure lip 41 applied on the second side 18 of the coverlid. The closure lip is preferably applied in a lower central part of the second side. When the box is closed, the closure lip 41 engages into a slit 40 applied in the first strip 9. The slit is preferably applied in a lower central part of the first strip. The slit 40 thus has the function of enabling the closure lip 41 to penetrate into the slit 40 thereby closing the box. The closure lip preferably has an omega or arc shaped pattern and is obtained by applying a die-cut in the material of which the second side 18 is made. This pattern enables an easy handling, as it fits with the thumb of a user, and also a reliable closure. The closure lip is bendable along a hinge line 42. Upon closing the box, the closure lip 41 will reach the front side of the slit 40. The user will then engage the closure lip into the slit by bending the closure lip along the hinge line 42. Once the closure lip is engaged into the slit the coverlid is attached with opposite sides on the base recipient, thereby providing a secure connection between the base recipient and the coverlid.

Figure 3:
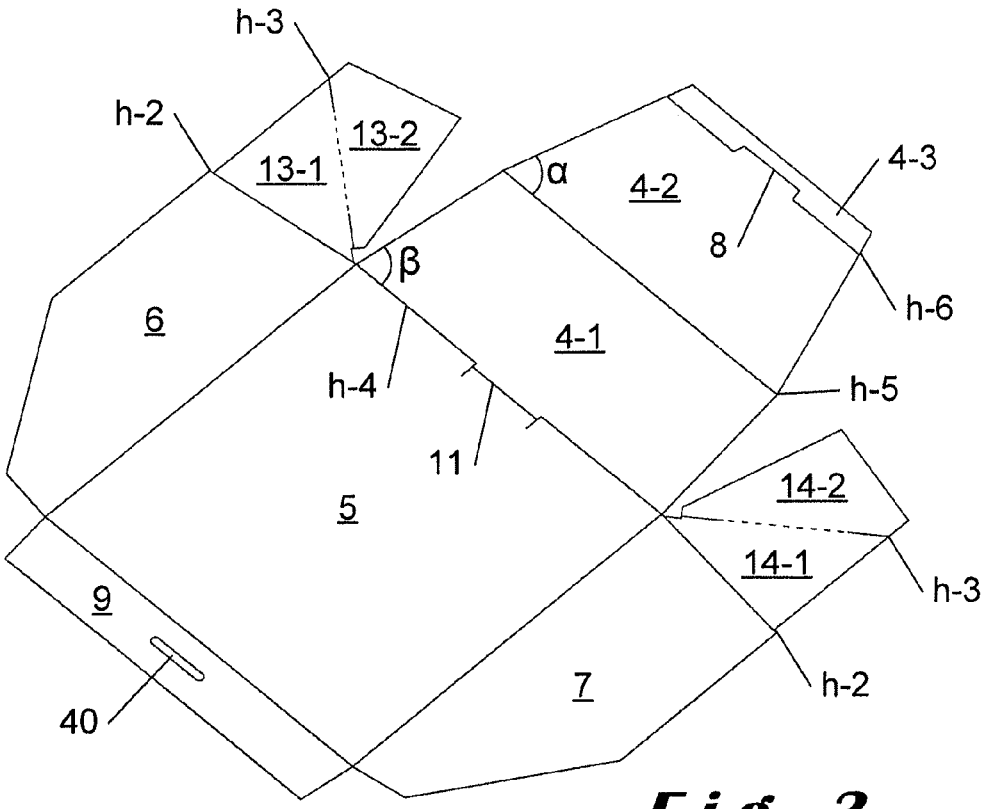
FIG. 3 shows a detailed view of the unfolded base recipient.
Figure 6:
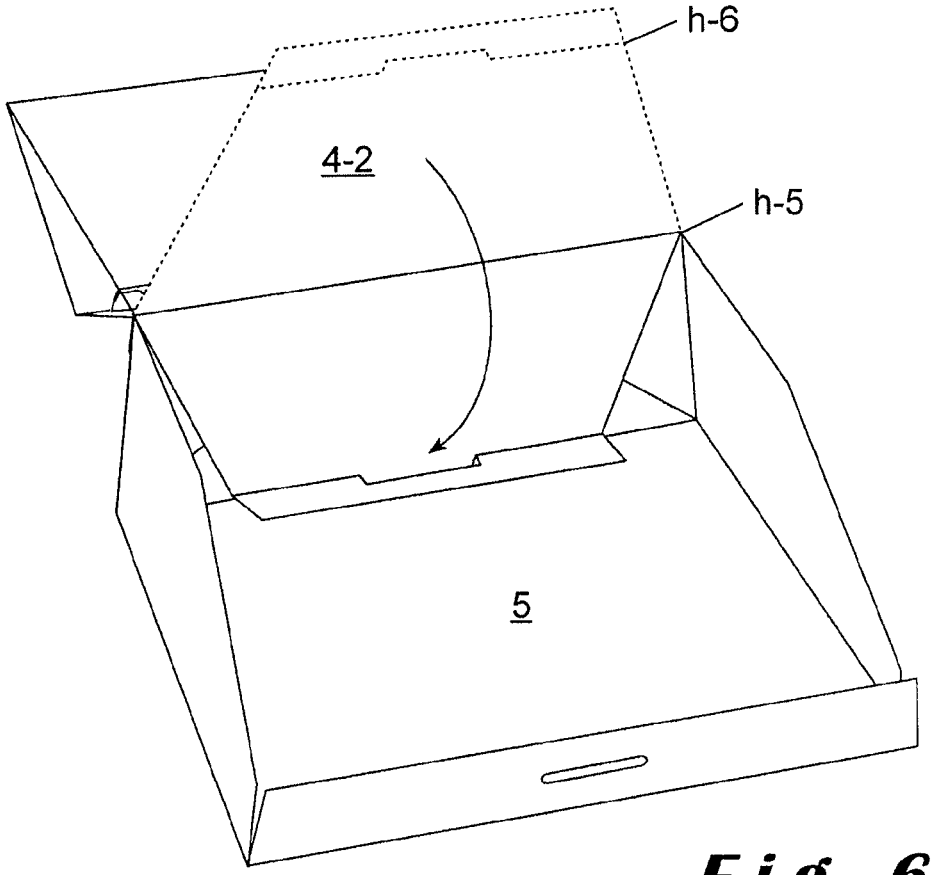
FIGS. 6 to 8 illustrate the mounting of the box.

FIG. 3 illustrates the base recipient in its form just after having been cut-out from a sheet of cardboard. The shown form is completely folded open. The back wall 4 comprises a first 4-1 and a second 4-2 flap. The latter form an integral part with each other and are foldable with respect to each other along the folding line h-5. The back wall 4 is foldable with respect to the bottom side 5 along folding line h-4. When the box is mounted, the back wall is upstanding, as illustrated in FIG. 6, and the first and second flap overlap each other. The first and second flaps are preferably shaped as a trapezium in order to match the trapezium shape of the box. However the inclination angle $\alpha$ between the lateral side of the second flap and the hinge line h-5 is less than the inclination angle $\beta$ of those of the first flap. The smaller inclination angle $\alpha$ enables the second flap not to interfere with the cavities 22 and 23. The first flap forms an outer part of the back wall, while the second flap forms the inner part of the back wall.

The second flap 4-2 comprises a lip 8, which is preferably trapezium shaped and applied on a border of the second flap. The lip 8 is formed by a cut-out in a foot piece 4-3 forming an extension of the second flap. The lip is provided to penetrate into a further slit 11 applied in the bottom side 5 of the box. For this purpose the further slit 11 is dimensioned and applied such as to engage the lip 8 when the base recipient is in its mounted configuration. The foot piece 4-3 is foldable along the hinge line h-6 and extends substantially in parallel with the bottom side 5 when the base recipient is in its mounted configuration.

Figure 4:
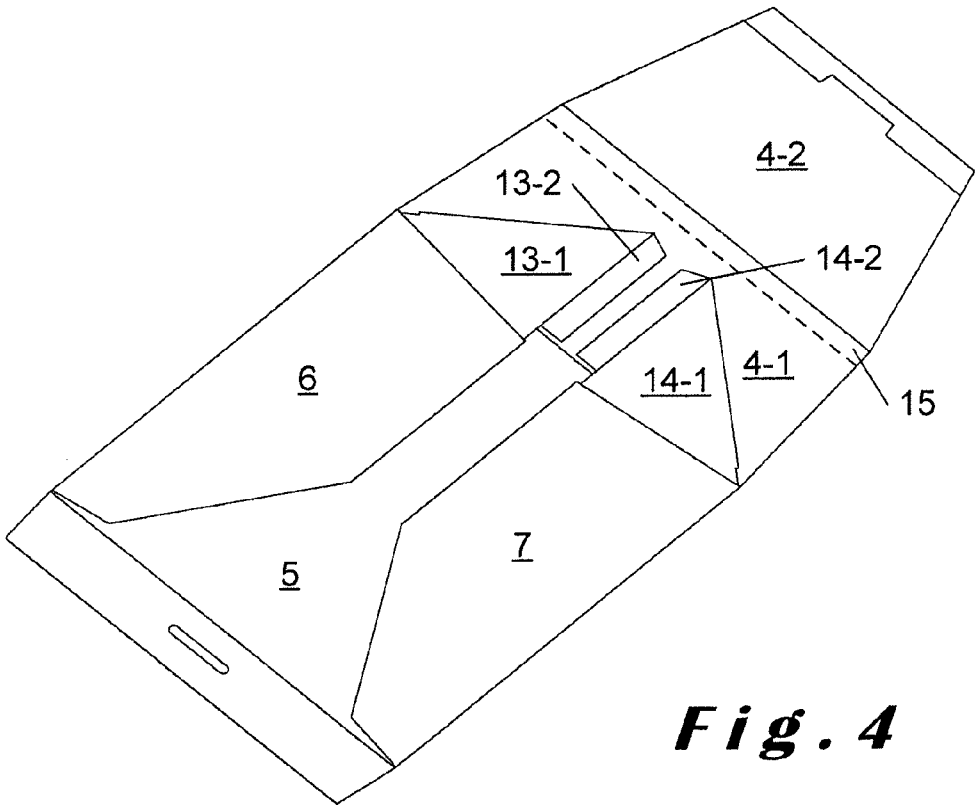
FIG. 4 shows a view of the base recipient where the wings are attached to the first flap.
Figure 5:
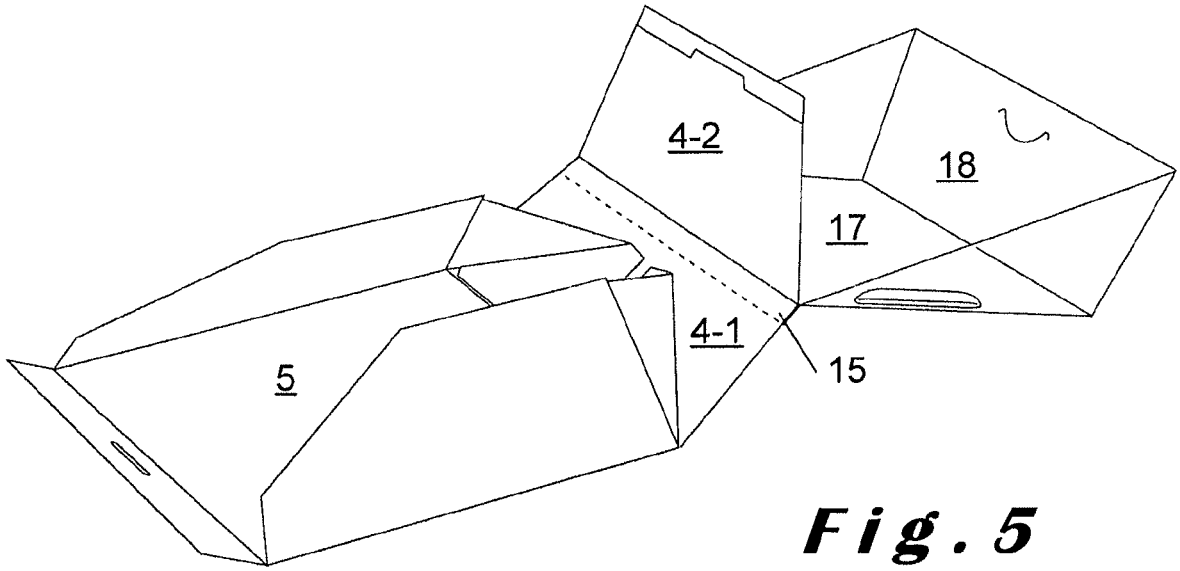
FIG. 5 shows an overall view of the base recipient with the coverlid attached thereto.

The first 6, respectively the second 7 side wall, is hingedly connected by means of a first 13, respectively a second 14 wing to the back wall 14 of the box, as illustrated in the FIGS. 4 and 5. The wings are integrally made with their respective side wall. The wings each comprise a first 13-1, 14-1 and a second 13-2, 14-2 segment, which are hingedly linked to each other. The hinge line h-3 forms the transition between the first and second segment of the wings. The hinge line h-2 forms the transition between the side wall and its annexed wing. The first segment forms each time an extension of the respective side wall. The second segments 13-2 and 14-2 are attached to the first flap 4-1, preferably they are glued thereon as this enables a quick and reliable attachment. The attachment of the second segments to the first flap is preferably realised during the manufacturing of the base recipient. When the second segments are attached to the first flap, the side walls and the second flaps can be folded so as to rest on the bottom side 5, as illustrated in FIG. 4.

The first segments are preferably triangular shaped as this fits with the foldable link with the side walls. The second segments have a triangular part and a rectangular part. The latter triangular part extends between the first segment and the rectangular part. The combination of a triangular and a rectangular part offers a good attachment with the first flap and can be easily formed by die cut.

The attachment of the coverlid to the base recipient is realised by means of an adhesive 15 layer applied on the first flap. The adhesive layer is preferably made by applying an adhesive coating layer on the first flap just under the folding line h-5. The adhesive, forming the adhesive layer, is preferably a thermal sensitive or hot melt adhesive, so that the coverlid is glued on the base recipient by heat application. Such a technique is known from the blister technique. The adhesive is applied on the base recipient when it is manufactured. The coverlid is preferably applied on the base recipient by placing the second strip 24 against the adhesive layer 15 and by applying heat on the second strip and the layer. The fact that the coverlid and the base recipient can now be glued to each other by using the adhesive layer 15 and the second strip, not only permits a quicker assembling, but also enables to stack the coverlid and the base member as a whole as there are no cams anymore.

The mounting of the box will now be described with reference to the FIGS. 6 to 8. The mounting can be done manually, as illustrated. Of course it is also possible to have the mounting done automatically by a machine. As illustrated in FIG. 10 the different boxes are stacked. The base recipient and the coverlid are already attached to each other, which enables a quicker handling and avoids having the coverlid and the base recipient attached to each other when they are unfolded. When the boxes are stacked, the first and second flap 4-1 and 4-2 extend in a same plane subsequently and adjacent to each other. The second flap 4-2 extends inside the volume delimited by the coverlid. The side walls 6 and 7 and their attached wings 13 and 14 are folded up so that they extend above the bottom side 5 as illustrated in FIG. 4. The first strip 9 is situated in the same plane as the bottom side.

After having taken a folded up box 1 from the stack 16, the second flap 4-2 is pulled up and folded along the hinge line h-1, as illustrated in FIG. 6. As the second flap forms one piece with the first flap, the pulling up of the second flap will cause the first 4-1 and second 4-2 flap to be tilted up, thereby causing the first flap to hinge along the hinge line h-4. Because the coverlid is attached to the first flap, the movement of the first flap will cause a movement of the coverlid. The latter will however have its common edge 21 preferably remaining on the support, on which the box is placed. Since the second segments 13-2 and 14-2 of the wings are fixed to the first flap 4-1, the hinged movement of the first flap will cause the second segments to be tilted up thereby causing the first segments 13-1 and 14-1 to unfold. Indeed, the tilting up of the second segments will cause a hinged movement along the hinge lines h-3 and h-2.

When the first flap is in its upright position, as illustrated in FIG. 6, the back wall and the side walls are standing up. The second flap 4-2 is now further folded over the hinge line h-5 so that a folding movement over an angle of 180° along the hinge line h-5 is achieved. In such a manner the second flap is pivoted inside the box, thereby covering the wings 13 and 14, which now extend between the first and second flap. The foot piece 4-3 is now folded along the hinge line h-6, so that the foot piece now extends in parallel with the bottom side. The foot piece prevents an inwards the box bending of the second flap, in particular when the fibre line of the cardboard extend in vertical direction with respect to the box. Once the second flap extends adjacent the first flap and parallel thereto and after folding of the foot piece, the lip 8 is engaged into the slit 11 thereby fixing the second flap to the bottom side of the box. The fixation of the second flap to the bottom side prevents that the second flap could bend back, which would cause the wing to bend back and the box to collapse. The coverlid is further attached to the base recipient by engaging the closure lip 41 into the slit 40.

Figure 7:
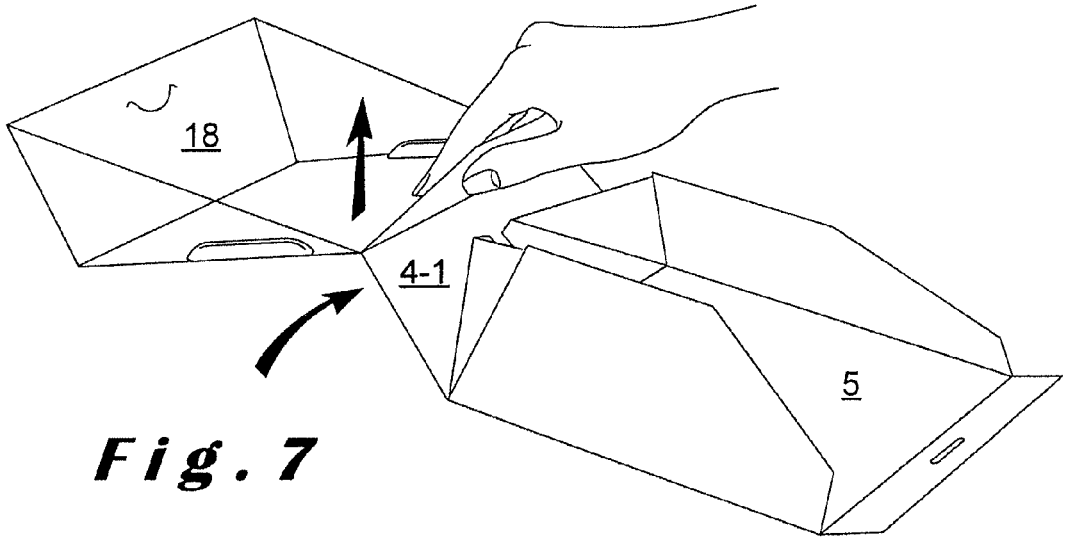
Figure 8:
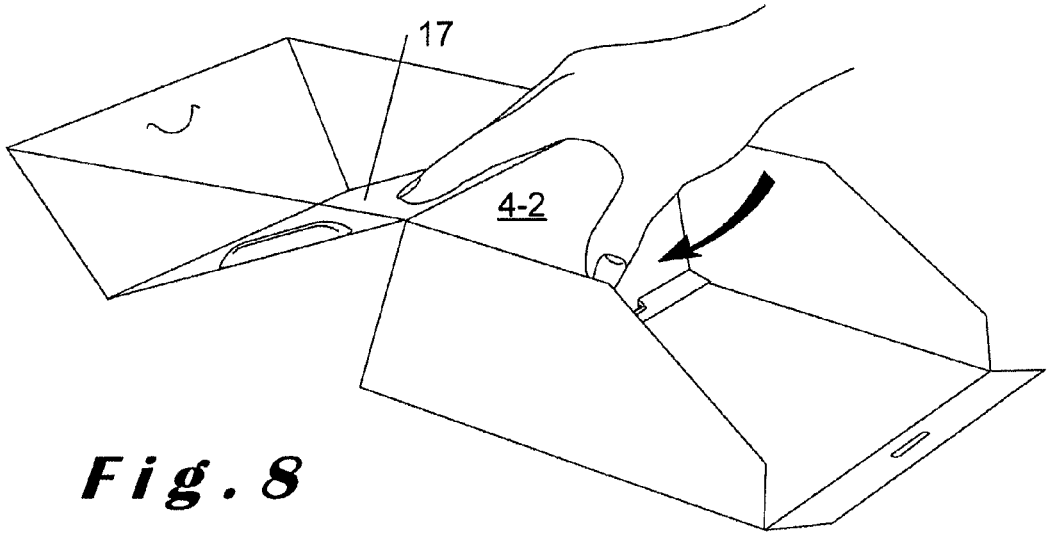
Figure 9:
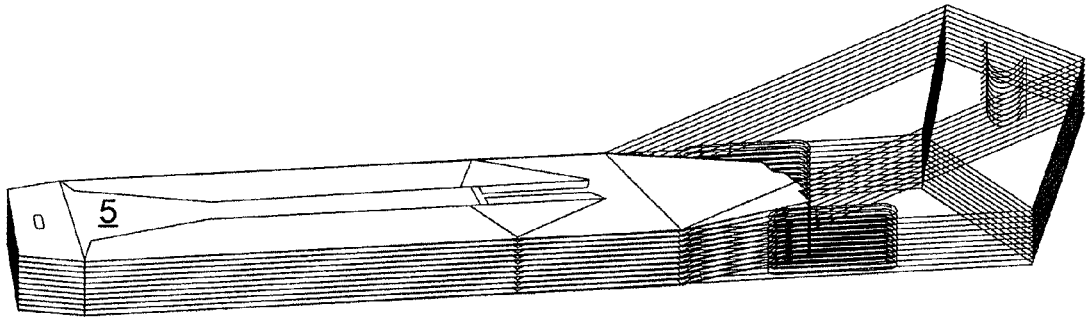
FIG. 9 illustrates how different boxes are stacked.

As illustrated in the FIGS. 7 and 8, the mounting of the box can be done using only one hand. For this purpose, the thumb is placed against the second flap and the coverlid is retained by the tops of one or more of the other fingers.

The invention claimed is:

1. A box, in particular a pastry box, comprising a coverlid and a base recipient, said coverlid being applied on said base recipient, said coverlid comprising a first side provided to form a top plane and a second side provided to form a front plane of said box, said first and second side having a common edge, said coverlid being further provided with a strip extending substantially perpendicular to said first side when said coverlid is mounted on said base recipient, and wherein said strip is hingedly applied to said first side of said coverlid at a position opposite to said common edge and, said base recipient being foldable and comprising a back wall, which is upstanding when said box is mounted, said strip being attached to said back wall, said back wall comprising a first and a second flap forming an integral part with each other and being foldable with respect to each other in such a manner that they overlap each other when said box is mounted, said base recipient further comprises a first and a second side wall hingedly connected by means of a first and a second wing respectively to said back wall in such a manner that upon mounting said box the upstanding movement of said back wall causes said side wall to become upstanding too, said strip being attached to said first flap in such a manner that a movement of said first flap will cause a movement of said coverlid.

2. The box as claimed in claim 1, characterised in that said first and said second wing extend between said first and second flap when said back wall is upstanding.

3. The box as claimed in claim 1, characterised in that said first flap forms an outer part of said back wall and said second flap forms an inner part of said back wall.

4. The box as claimed in claim 1, characterised in that said second flap comprises a bendable lip applied on a border thereof, said base recipient further comprising a bottom side provided with a slit, said slit being dimensioned and applied such as to engage said bendable lip when said base recipient is mounted.

5. The box as claimed in claim 4, characterised in that a foot piece is applied on said second flap as an extension thereof, said foot piece being bendable with respect to said second flap so as to extend substantially parallel with a bottom side of said base recipient when said box is mounted, and in that said bendable lip is formed by a cut-out in said foot piece.

6. The box as claimed in claim 4, characterised in that said bendable lip is trapezium shaped.

7. The box as claimed in claim 1, characterised in that a foot piece is applied on said second flap as an extension thereof, said foot piece being bendable with respect to said second flap so as to extend substantially parallel with a bottom side of said base recipient when said box is mounted.

8. The box as claimed in claim 1, characterised in that said first and second flap have the shape of a trapezium.

9. The box as claimed in claim 1, characterised in that said first and second wings each comprise a first and a second segment pivotably linked to each other, said first segment being attached to said side wall and said second segment being attached to said first flap.

10. The box as claimed in claim 9, characterised in that said first segment is triangularly shaped.

11. The box as claimed in claim 9, characterised in that said second segment is shaped by a juxtaposition of a triangular and a rectangular part.

12. The box as claimed in claim 9, characterised in that said second segment is glued to said first flap.

13. The box as claimed in claim 9, characterised in that said wings are integrally made with their respective side wall.

14. The box as claimed in claim 1, characterised in that said coverlid is made of transparent plastic material.

15. The box as claimed in claim 1, characterised in that said second side of said coverlid is provided with a closure lid and said base recipient with a further slit, said closure lid being provided to engage into said further slit upon closing said box.

16. The box as claimed in claim 1, characterised in that said strip is glued to said first flap.

17. The box as claimed in claim 1, characterised in that said base member is stackable.

* * * * *